US008360616B2

(12) United States Patent
Li

(10) Patent No.: US 8,360,616 B2
(45) Date of Patent: Jan. 29, 2013

(54) METHOD FOR INSTALLING A SECONDARY OPTICAL LENS ON A LED STREET LAMP

(76) Inventor: Xuliang Li, Dongguan (CN)

( * ) Notice: Subject to any disclaimer, the term of this patent is extended or adjusted under 35 U.S.C. 154(b) by 1217 days.

(21) Appl. No.: 12/182,154

(22) Filed: Jul. 30, 2008

(65) Prior Publication Data

US 2009/0034269 A1 Feb. 5, 2009

(30) Foreign Application Priority Data

Jul. 31, 2007 (CN) ..... 2007 1 0075375

(51) Int. Cl.
*F21V 3/00* (2006.01)

(52) U.S. Cl. ..... 362/311.02; 362/244; 362/431; 362/800; 362/249.02

(58) Field of Classification Search ..... 362/800, 362/332, 244, 267, 249.02, 308, 326, 235, 362/311.02
See application file for complete search history.

(56) References Cited

U.S. PATENT DOCUMENTS

2007/0085103 A1* 4/2007 Nishioka et al. ..... 257/99
2008/0080189 A1* 4/2008 Wang ..... 362/294
2008/0273325 A1* 11/2008 Wilcox et al. ..... 362/240

* cited by examiner

*Primary Examiner* — Jason Moon Han
*Assistant Examiner* — Jessica M Apenteng

(57) ABSTRACT

A method of installing a secondary optical lens on a LED street lamp comprises the first step of installing a secondary optical lens on a lens floor and the second step of installing the lens floor with the secondary optical lens and a LED arrayed board on the body of the LED street lamp. By this method, LED bulb and secondary optical lens can contact directly and be located precisely.

4 Claims, 6 Drawing Sheets

METHOD FOR INSTALLING A SECONDARY OPTICAL LENS ON A LED STREET LAMP

FIELD OF THE INVENTION

The present invention relates to a LED street lamp. More particularly, the exemplary embodiments herein provide a method of installing a secondary optical lens on a LED street lamp.

BACKGROUND OF THE INVENTION

LED street lamp instead of traditional street lamp is a revolution in the field of public utilities because the LED street lamp is well known as saving energy, desirable color, free maintenance, and long service life compared with traditional street lamp. At present, high-power LED street lamp is in the stage of test or trial production, but hardly formally used, although many magnates in illumination industry in the global market have set foot in the field of high-power LED street lamp.

The basic research in high-power LED street lamp has made a breakthrough, for example, A Chinese Patent which has publication Number as(CN1928624A) applied by Tsinghua University discloses a method of designing a 3D optical lens, which provides a kind of immersion lens with low loss and strong phototactic reaction on P.13 of Description and P.8 of Drawings. However, the actual effects of the lens is not perfect, because of the high costs of encapsulation as a primary lens, and the fault of the chips which will lead to scrap with lens and cause the waste accordingly. Moreover, as a secondary lens, when install a secondary lens in front of a LED bulb rigidly usually, the positional error of secondary lens is not avoided as the installing positional error of LED bulb which includes scraping tin, surface mounting, and welding. These will lead to a problem which is the big positional accumulated error of secondary lens relative to LED bulb, thus cause the clearence between LED bulb and secondary lens. Therefore, the problems will increase the optical loss and decrease the performance of lens itself, and the popularization and application of the secondary lens is limited.

SUMMARY OF THE INVENTION

The object of the present invention is to provide a method of installing a secondary optical lens on a LED street lamp, which overcome the defects of existing technology mentioned above, and make LED bulb and secondary optical lens contact directly and locate precisely.

DETAILED DESCRIPTION OF PREFERRED EMBODIMENTS

Figure 1:
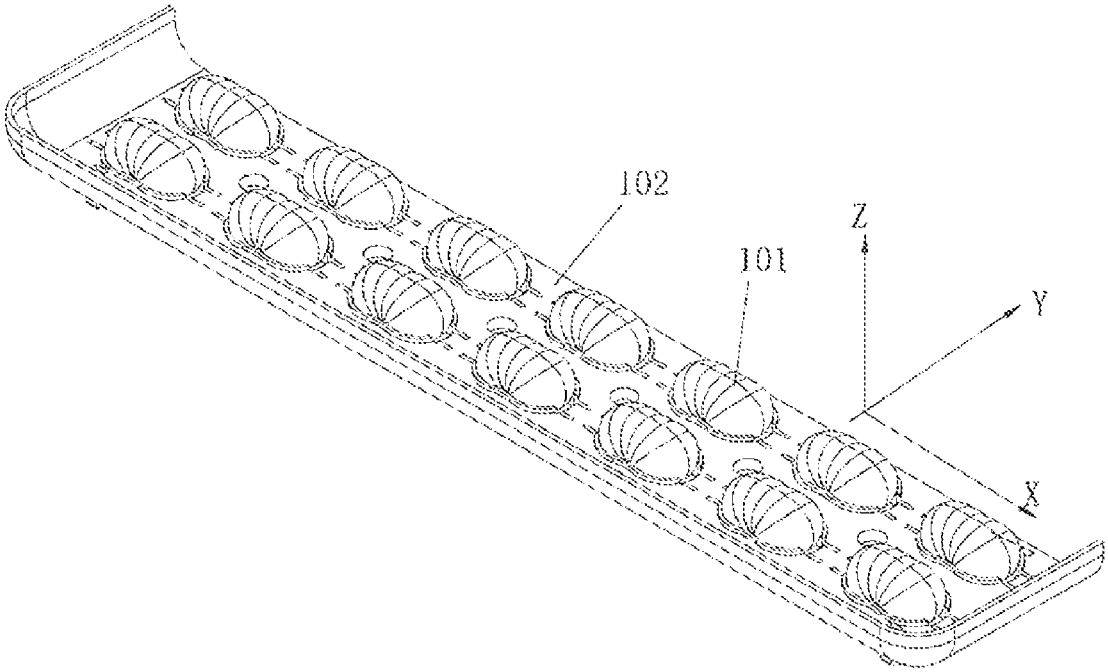
FIG. 1 is a cubic chart showing a lens floor installing a secondary optical lens in an embodiment of the present invention.
Figure 2:
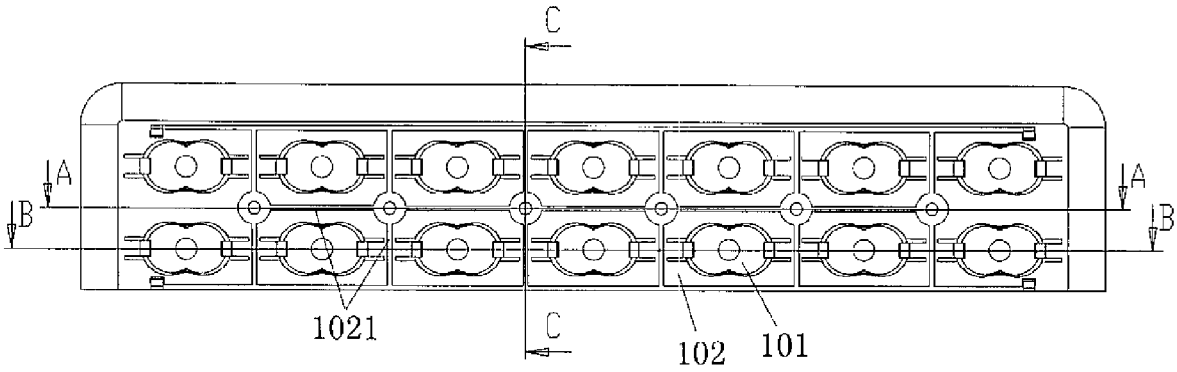
FIG. 2 is a front view showing a lens floor installing a secondary optical lens in an embodiment of the present invention.
Figure 3:
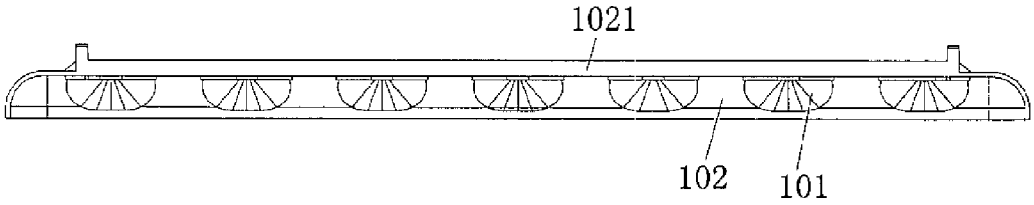
FIG. 3 is a bottom view showing a lens floor installing a secondary optical lens in an embodiment of the present invention.
Figure 4:
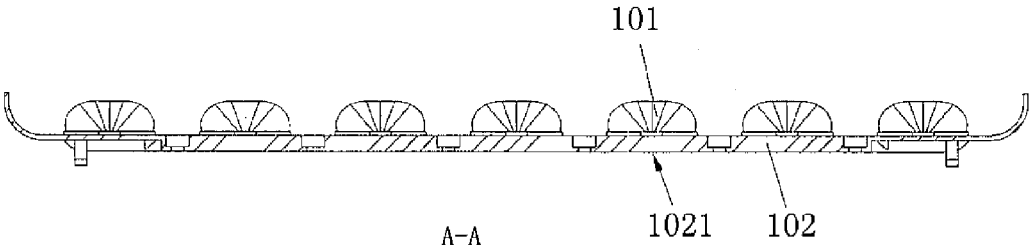
FIG. 4 is a cut-out plan view of A-A in FIG. 2 of the present invention.
Figure 5:
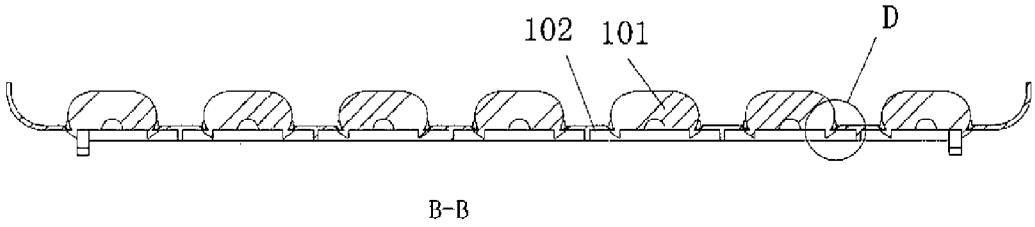
FIG. 5 is a cut-out plan view of B-B in FIG. 2 of the present invention.
Figure 6:
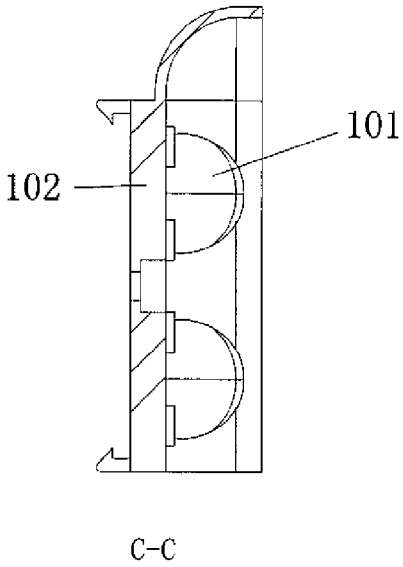
FIG. 6 is a cut-out enlarged view of C-C in FIG. 2 of the present invention.
Figure 7:
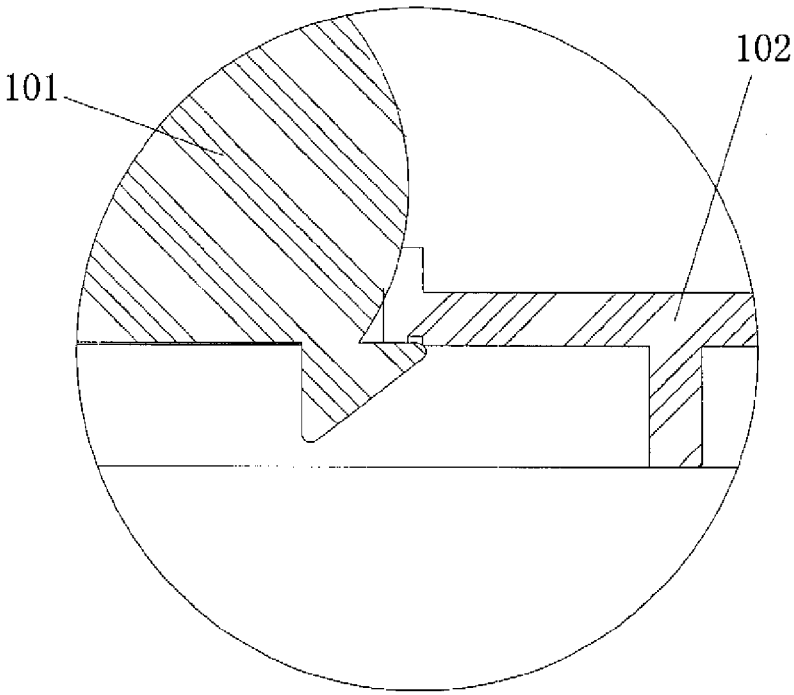
FIG. 7 is an enlarged view of D in FIG. 5 of the present invention.
Figure 8:
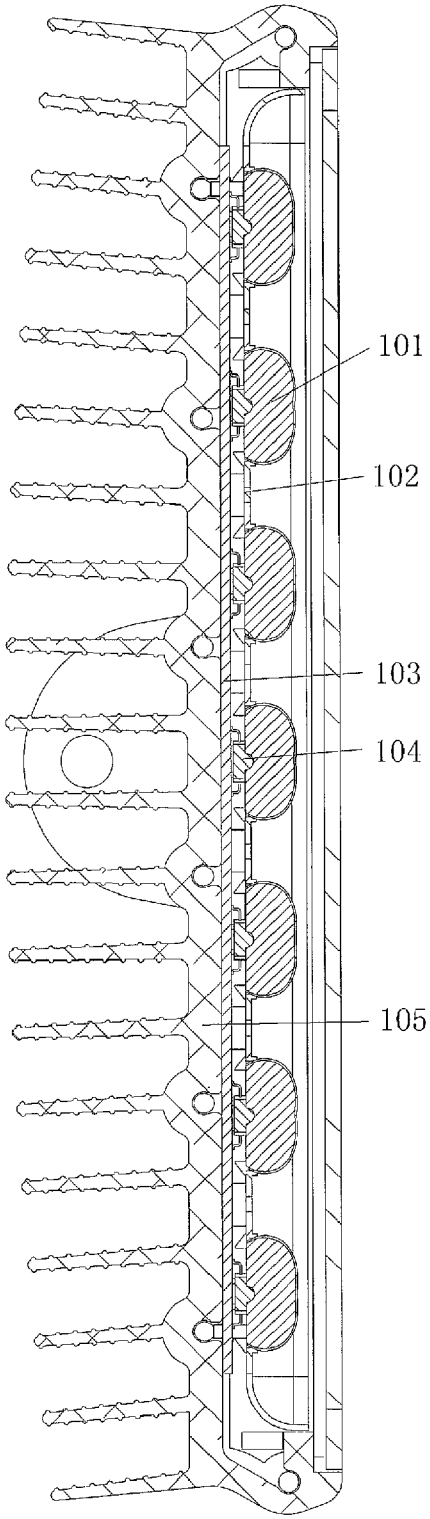
FIG. 8 is a cut-out plan view showing a body of LED street lamp installing a lens floor with secondary optical lens and LED arrayed board in an embodiment of the present invention.

The present invention provides a method of installing a secondary optical lens on a LED street lamp comprising, a. installing said secondary optical lens on a lens floor;

said lens floor has a plurality of lens mounting hole which has two elastic tongue pieces symmetrically on the edge;

said secondary optical lens has a dent in flat bottom which has two hooks symmetrically outside the bottom face, and said dent has the same shape with the convex top of a LED bulb;

said bottom of said secondary optical lens is in close contact with the front of said lens floor, said dent of said secondary optical lens falls into the area of said lens mounting hole, said two hooks buckle said two tongue pieces on the edge of lens mounting hole;

said two hooks of said secondary optical lens have clearance along the x axis and y axis of said lens floor in the area of lens mounting hole, when give a force to said secondary optical lens along the z axis, that is, vertical to said lens floor, which make said secondary optical lens have the trend of leaving said lens floor, said secondary optical lens will move along the z axis, meanwhile, overcome the elastic force of said two tongue pieces on the edge of lens mounting hole;

each of said lens mounting hole corresponds to one of said secondary optical lens;

b. install said lens floor placed said secondary optical lens and a LED arrayed board on the body of said LED street lamp;

combine the back of said lens floor placed said secondary optical lens with the front of said LED arrayed board which has a plurality of LED bulb, that is, the position of said LED bulb corresponds to the position of said secondary optical lens;

said body of LED street lamp has a capacity space, where the back of said LED arrayed board is in close contact with the bottom of said capacity space, the back of said lens floor placed said secondary optical lens is in close contact with the front of said LED arrayed board, and said LED arrayed board and said lens floor make the fixd connection to said body of LED street lamp with a fastener.

A method of installing a secondary optical lens on a LED street lamp, wherein said lens floor of step a is one block, said LED arrayed board of step b is also one block, and said capacity space in the body of LED street lamp of step b is one cavity.

A method of installing a secondary optical lens on a LED street lamp, wherein said lens floor of step a is more than one block, said LED arrayed board of step b is also more than one block, however, said capacity space in the body of LED street lamp of step b is one cavity.

A method of installing a secondary optical lens on a LED street lamp, wherein said lens floor of step a is more than one block, said LED arrayed board of step b is also more than one block, and said capacity space in the body of LED street lamp of step b is more than one cavity.

A method of installing a secondary optical lens on a LED street lamp, wherein said lens floor of step a is flat, said LED arrayed board of step b is also flat, and said bottom of capacity space in the body of LED street lamp of step b is plane.

A method of installing a secondary optical lens on a LED street lamp, wherein said lens floor has two blocks, said LED arrayed board also has two blocks, and said capacity space in the body of LED street lamp has two cavities, the shape of said body of LED street lamp is "八" figure, where said two cavities placed in "八" shape respectively.

A method of installing a secondary optical lens on a LED street lamp, wherein said lens floor of step a is arc, said LED arrayed board of step b is also arc, and said bottom of capacity space in the body of LED street lamp of step b is arc surface.

A method of installing a secondary optical lens on a LED street lamp, wherein the front of said arc lens floor is concave, the front of said LED arrayed board is concave, and said arc bottom of capacity space in the body of LED street lamp is concave surface.

A method of installing a secondary optical lens on a LED street lamp, wherein said lens floor of step a is spherical, said LED arrayed board of step b is also spherical, and said bottom of capacity space in the body of LED street lamp of step b is spherical surface.

A method of installing a secondary optical lens on a LED street lamp, wherein the front of said spherical lens floor is concave, the front of said LED arrayed board is concave, and said spherical bottom of capacity space in the body of LED street lamp is concave surface.

A method of installing a secondary optical lens on a LED street lamp, wherein said LED arrayed board and said lens floor make the fixd connection to said bottom of capacity space in the body of LED street lamp with a screw, the back of said lens floor has a plurality of outshoot which limits the distance between said lens floor and said LED arrayed board.

The present invention also provides a method of installing a secondary optical lens on a LED street lamp comprising, a. install said secondary optical lens on a lens floor;

said lens floor has a plurality of lens mounting hole which is circular, said lens mounting hole has three elastic tongue pieces evenly distributed on the edge;

said secondary optical lens has a dent in flat bottom, said dent has the same shape with the convex top of a LED bulb, and three hooks which are outside the bottom face evenly distributed around said dent;

said bottom of said secondary optical lens is in close contact with the front of said lens floor, said dent of said secondary optical lens falls into the area of said lens mounting hole, said three hooks buckle said three tongue pieces on the edge of lens mounting hole;

said two hooks of said secondary optical lens have clearance along the x axis and y axis of said lens floor in the area of lens mounting hole, when give a force to said secondary optical lens along the z axis, that is, vertical to said lens floor, which make said secondary optical lens have the trend of leaving said lens floor, said secondary optical lens will move along the z axis, meanwhile, overcome the elastic force of said two tongue pieces on the edge of lens mounting hole;

each of said lens mounting hole corresponds to one of said secondary optical lens;

b. install said lens floor placed said secondary optical lens and a LED arrayed board on the body of said LED street lamp;

combine the back of said lens floor placed said secondary optical lens with the front of said LED arrayed board which has a plurality of LED bulb, that is, the position of said LED bulb corresponds to the position of said secondary optical lens;

said body of LED street lamp has a capacity space, where the back of said LED arrayed board is in close contact with the bottom of said capacity space, the back of said lens floor placed said secondary optical lens is in close contact with the front of said LED arrayed board, and said LED arrayed board and said lens floor make the fixd connection to said body of LED street lamp with a fastener.

The present invention has two independent technical schemes which subordinate to one invention conception and has the common technical feature, that is, installing secondary optical lens on lens floor with elastic tongue pieces, and then installing lens floor placed secondary optical lens and LED arrayed board on the body of LED street lamp, thus as one application.

The method of installing a secondary optical lens on a LED street lamp provided in present invention overcome the defects of existing technology which is the installing positional error and the clearance between LED bulb and secondary lens, because the elastic tongue pieces can make up the installing positional error, thus make secondary optical lens in close contact with LED bulb. Moreover, the installing positional error of secondary lens along the x axis and y axis of said lens floor relative to LED bulb can be corrected by the auto alignment of the convex top of a LED bulb and the dent in secondary optical lens, because the secondary optical lens have clearance with lens floor along the x axis and y axis of the lens floor, and the secondary optical lens has a dent in the bottom which has the same shape with the convex top of a LED bulb, which realize the precise positioning.

EXAMPLES

In the following paragraphs, description will be made with reference to the drawings.

Figure 9:
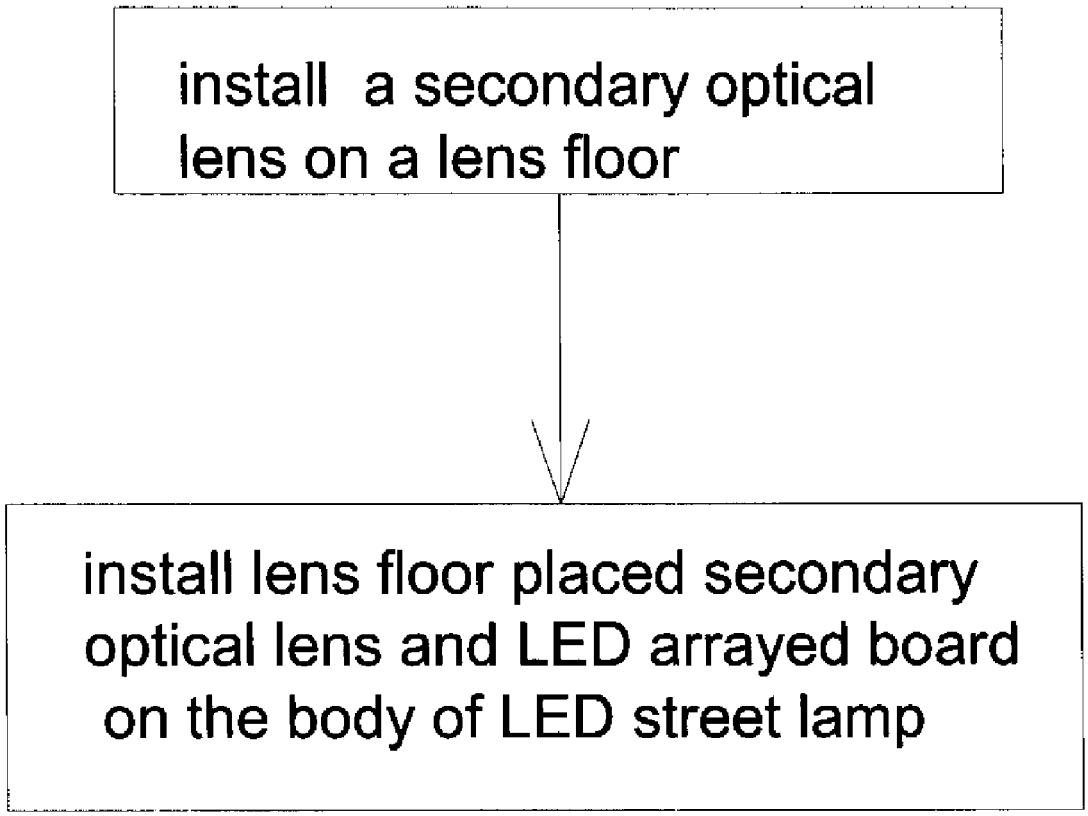
FIG. 9 is a flow chart in an embodiment of the present invention.

A preferred embodiment of the present invention provides a method of installing a secondary optical lens on a LED street lamp as shown by FIG. 9 comprising the first step of installing a secondary optical lens on a lens floor and the second step of installing said lens floor with said secondary optical lens and a LED arrayed board on the body of said LED street lamp. The following detailed description of said secondary optical lens, said lens floor, and said LED arrayed board, and said body of LED street lamp in the embodiment will be taken in conjunction with FIGS. 1-9.

Said lens floor 102 has a plurality of lens mounting hole which has two elastic tongue pieces symmetrically on the edge; said secondary optical lens 101 has a dent in flat bottom which has two hooks symmetrically outside the bottom face, and said dent has the same shape with the convex top of a LED bulb 104; said bottom of said secondary optical lens 101 is in close contact with the front of said lens floor 102, said dent of said secondary optical lens 101 falls into the area of said lens mounting hole, said two hooks buckle said two tongue pieces on the edge of lens mounting hole; said two hooks of said secondary optical lens 101 have clearance along the x axis and y axis of said lens floor 102 in the area of lens mounting hole, when give a force to said secondary optical lens 101 along the z axis, that is, vertical to said lens floor 102, which make said secondary optical lens 101 have the trend of leaving said lens floor 102, said secondary optical lens 101 will move along the z axis, meanwhile, overcome the elastic force of said two tongue pieces on the edge of lens mounting hole; each of said lens mounting hole corresponds to one of said secondary optical lens 101; combine the back of said lens floor 102 placed said secondary optical lens 101 with the front of said LED arrayed board 103 which has a plurality of LED bulb 104, that is, the position of said LED bulb 104 corresponds to the position of said secondary optical lens 101; said body of LED street lamp 105 has a capacity space, where the back of said LED arrayed board 103 is in close contact with the bottom of said capacity space, the back of said lens floor 102 placed said secondary optical lens 101 is in close contact with the front of said LED arrayed board 103, and said LED arrayed board 103 and said lens floor 102 make the fixd connection to said body of LED street lamp 105 with a screw.

Said lens floor 102 in the embodiment has six blocks, said LED arrayed board 103 also has six blocks correspondingly, however, said capacity space in the body of LED street lamp 105 is one cavity. Combine all said lens floor 102 with all said LED arrayed board 103, and placed in one said capacity space. Apparently, said body of LED street lamp can have more than one cavity, and the combination of said lens floor and said LED arrayed board in each of capacity space can be one group of combination or more than one group of combination. Said lens floor 102 in the embodiment is flat, said LED arrayed board 103 is also flat, and the bottom of said capacity space in the body of LED street lamp 105 is plane. Apparently, said lens floor, said LED arrayed board, and the bottom of said capacity space in the body of LED street lamp can be arc surface or spherical surface, moreover, can be concave surface or convex surface for different results of different launching light. The back of said lens floor has a plurality of outshoot 1021 which limits the distance between said lens floor and said LED arrayed board. Said elastic tongue pieces in the embodiment are on the edge of said lens mounting hole in said lens floor 102, both sides of said tongue pieces have open slot, and only the root of said tongue pieces connects with said lens floor 102.

Figure 10:
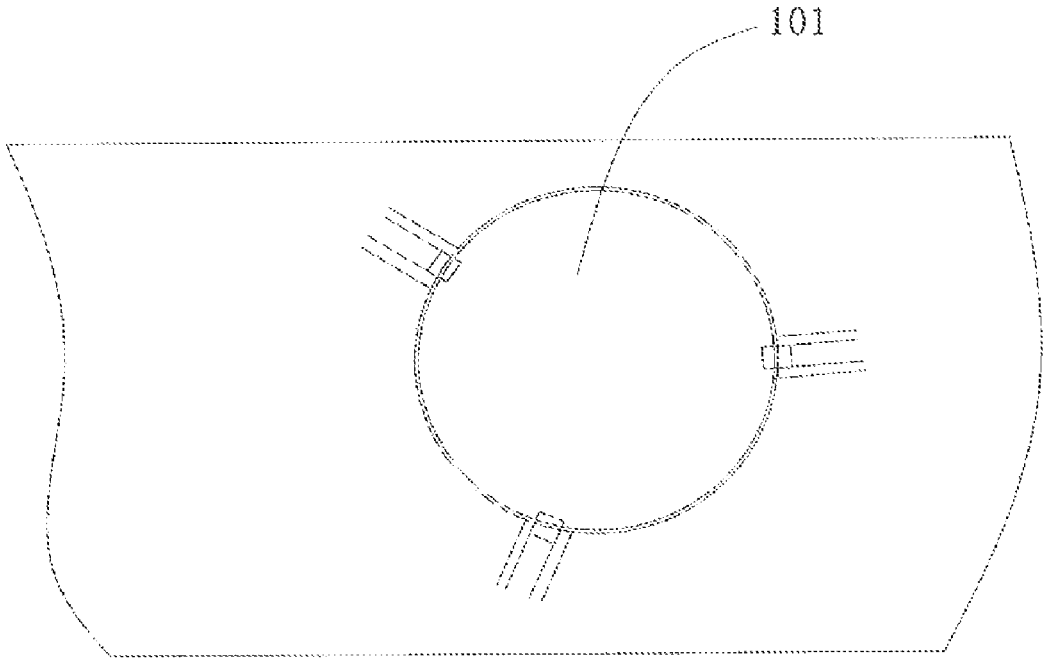
FIG. 10 is a diagrammatic sketch top view which shows position of three hooks and three tongues of a second embodiment.

A second embodiment of the present invention provides a method of installing a secondary optical lens on a LED street lamp comprising, and the steps are the same as the first embodiment of the present invention. The difference in second embodiment is that, referring to FIG. 10, said secondary optical lens has three hooks evenly distributed around said dent, said lens floor has three elastic tongue pieces correspondingly, the second embodiment is suitable to a secondary optical lens with circular horizontal section.

What is claimed is:

1. A method of installing a secondary optical lens on a LED street lamp comprising, a. install said secondary optical lens on a lens floor;

said lens floor has a plurality of lens mounting holes, each of which has two elastic tongue pieces symmetrically on the edge;

said secondary optical lens has a flat bottom, a dent which has the same shape with convex top of a LED bulb is mounted to said bottom, and two hooks extruding out of said bottom are respectively and symmetrically mounted to both sides of said dent;

said bottom of said secondary optical lens is in close contact with front of said lens floor, said dent of said secondary optical lens locates into area of said lens mounting hole, and said two hooks buckle said two tongue pieces on the edge of lens mounting hole;

said two hooks of said secondary optical lens have clearance along the x axis and y axis of said lens floor in the area of said lens mounting hole, when given a force to said secondary optical lens along the z axis that is vertical to said lens floor, which make said secondary optical lens have the trend of leaving said lens floor, said secondary optical lens will move along the z axis, meanwhile, overcome the elastic force of said two tongue pieces on the edge of lens mounting hole;

each of said lens mounting holes corresponds to one of said secondary optical lens;

b. install said lens floor which has said secondary optical lens and a LED arrayed board the body of said LED street lamp;

combine the back of said lens floor which has said secondary optical lens with the front of said LED arrayed board on which a plurality of LED bulbs are mounted, make the position of said LED bulb corresponds to the position of said secondary optical lens, and make convex top of each of said LED bulb locate in one said dent of said secondary optical lens though said lens mounting hole;

said body of LED street lamp has a capacity space, where the back of said LED arrayed board is in close contact with the bottom of said capacity space, the back of said lens floor which has said secondary optical lens is in close contact with the front of said LED arrayed board, and said LED arrayed board and said lens floor make the fixed connection to said body of LED street lamp with a fastener.

2. A method of installing a secondary optical lens on a LED street lamp in accordance with claim 1, wherein said lens floor of step a is more than one block, said LED arrayed board of step b is also more than one block, however, said capacity space in the body of LED street lamp of step b is one cavity.

3. A method of installing a secondary optical lens on a LED street lamp in accordance with claim 1, wherein said lens floor of step a is flat, said LED arrayed board of step b is also flat, and said bottom of capacity space in the body of LED street lamp of step b is plane.

4. A method of installing a secondary optical lens on a LED street lamp comprising, a. install said secondary optical lens on a lens floor;

said lens floor has a plurality of lens mounting holes, each of which is circular, and each of said lens mounting hole has three elastic tongue pieces evenly distributed on the edge;

said secondary optical lens has a flat bottom, a dent which has the same shape with convex top of a LED bulb is mounted to said bottom, and three hooks extruding out of said bottom are evenly distributed around said dent;

said bottom of said secondary optical lens is in close contact with front of said lens floor, said dent of said secondary optical lens locates into area of said lens mounting hole, said three hooks buckle said three tongue pieces on the edge of lens mounting hole;

said three hooks of said secondary optical lens have clearance along the x axis and y axis of said lens floor in the area of said lens mounting hole, when given a force to said secondary optical lens along the z axis that is vertical to said lens floor, which make said secondary optical lens have the trend of leaving said lens floor, said secondary optical lens will move along the z axis, meanwhile, overcome the elastic force of said three tongue pieces on the edge of lens mounting hole;

each of said lens mounting holes corresponds to one of said secondary optical lens;

b. install said lens floor which has said secondary optical lens and a LED arrayed board onto the body of said LED street lamp;

combine the back of said lens floor which has said secondary optical lens with the front of said LED arrayed board on which a plurality of LED bulbs are mounted, and make the position of said LED bulb corresponds to the position of said secondary optical lens, and make convex top of each of said LED bulb locate in one said dent of said secondary optical lens through said lens mounting hole;

said body of LED street lamp has a capacity space, where the back of said LED arrayed board is in close contact with the bottom of said capacity space, the back of said lens floor which has said secondary optical lens is in close contact with the front of said LED arrayed board, and said LED arrayed board and said lens floor make the fixed connection to said body of LED street lamp with a fastener.

* * * * *